US012214946B2

(12) United States Patent
Maxted

(10) Patent No.: US 12,214,946 B2
(45) Date of Patent: Feb. 4, 2025

(54) FUSIBLE TIE BAND

(71) Applicant: Daikin Comfort Technologies Manufacturing, L.P., Waller, TX (US)

(72) Inventor: James K. Maxted, Cypress, TX (US)

(73) Assignee: Daikin Comfort Technologies Manufacturing, L.P., Waller, TX (US)

( * ) Notice: Subject to any disclaimer, the term of this patent is extended or adjusted under 35 U.S.C. 154(b) by 0 days.

(21) Appl. No.: 17/932,921

(22) Filed: Sep. 16, 2022

(65) Prior Publication Data

US 2024/0092546 A1 Mar. 21, 2024

(51) Int. Cl.
*B65D 63/10* (2006.01)
*F24F 13/24* (2006.01)

(52) U.S. Cl.
CPC ..... *B65D 63/1027* (2013.01); *F24F 13/24* (2013.01)

(58) Field of Classification Search
CPC ..... B65D 63/1027; Y10T 24/1498; A61M 25/02; F16L 2/233; F16B 2/08
See application file for complete search history.

(56) References Cited

U.S. PATENT DOCUMENTS 2,961,785 A * 11/1960 Toepfer ..... G09F 3/04 24/DIG. 43
3,118,200 A * 1/1964 Bell ..... B65D 63/1081 D8/383
4,214,349 A * 7/1980 Munch ..... B65D 63/1081 24/16 PB
4,263,697 A * 4/1981 Speedie ..... B65D 63/1081 24/17 AP
4,347,648 A * 9/1982 Dekkers ..... B65D 63/1063 24/17 AP
4,389,754 A * 6/1983 Sohma ..... F16L 3/137 24/17 AP
4,477,950 A * 10/1984 Cisek ..... B65D 63/1027 24/17 AP
4,728,064 A * 3/1988 Caveney ..... B65D 63/1081 248/74.3
5,154,376 A * 10/1992 Baum ..... F16L 3/2332 248/74.3

(Continued)

FOREIGN PATENT DOCUMENTS

CN 105857911 A 8/2016
EP 0999986 B1 4/2002
JP 5493043 B2 5/2014

OTHER PUBLICATIONS

International Search Report and Written Opinion dated Nov. 28, 2023 for corresponding PCT Patent Application PCT/US2023/072497 filed on Aug. 18, 2023.

*Primary Examiner* — Robert Sandy
*Assistant Examiner* — Rowland Do
(74) *Attorney, Agent, or Firm* — K&L Gates LLP

(57) ABSTRACT

A tie band with various locking methods is disclosed. The tie band can include a head and a band extending from the head. The head includes a first flange, a second flange, and a connector connecting the first flange and the second flange. The connector defines a hole in the head. The band includes two elongate faces, two side faces, and protrusions extending from the side faces. In some aspects, the band is fusible to the head by applying heat to the head, at least one of the protrusions, or a combination thereof when the portion of the band is inserted through the hole.

20 Claims, 8 Drawing Sheets

(56) References Cited

U.S. PATENT DOCUMENTS

| | | | | |
|---|---|---|---|---|
| 5,685,048 | A * | 11/1997 | Benoit | B65D 63/1063 24/17 AP |
| 6,105,908 | A * | 8/2000 | Kraus | F16L 3/233 248/74.3 |
| 6,260,210 | B1 * | 7/2001 | Sjostrom | A61B 5/107 2/325 |
| 6,497,393 | B1 * | 12/2002 | Crosslen | F16M 13/02 248/176.1 |
| D729,054 | S * | 5/2015 | Chen | D8/356 |
| 9,939,086 | B1 * | 4/2018 | Mangone, Jr. | F16L 3/233 |
| 2005/0115028 | A1 * | 6/2005 | Cheung | B65D 63/1027 24/16 PB |
| 2006/0096066 | A1 * | 5/2006 | Wambaugh | B65D 63/1063 24/16 PB |
| 2010/0212118 | A1 | 8/2010 | Shigematsu et al. | |
| 2013/0333163 | A1 | 12/2013 | Chen | |
| 2018/0009556 | A1 * | 1/2018 | Milbrandt | B65D 63/109 |
| 2018/0141732 | A1 * | 5/2018 | Seok | F16L 3/233 |
| 2018/0282036 | A1 | 10/2018 | Watson | |
| 2021/0244917 | A1 * | 8/2021 | Albertsen | F16B 2/08 |
| 2022/0332485 | A1 * | 10/2022 | Beckman | B65D 63/1027 |

* cited by examiner

FUSIBLE TIE BAND

BACKGROUND

Tie bands, which are sometimes referred to as cable ties or zip ties, are a type of fastener that may be used to hold various objects together. For example, a tie band may be used to bundle electrical wires together. As another example, tie bands may be used to secure a heat exchanger within a commercial heating, ventilation, and air conditioning (HVAC) unit. Thus, in some cases, tie bands may be exposed to vibration, such as the vibration caused by various motors and fans within a commercial HVAC unit.

Current tie bands are often constructed using nylon materials, such as nylon 6/6, which comprises monomers of hexamethylenediamine and adipic acid. However, nylon materials may exhibit a relativity low coefficient of friction when placed against other materials such as electrical wire insulation or the metal used to construct HVAC units. Thus, when used to bundle objects together, such as electrical wires, nylon tie bands may provide a less-than-desirable resistance to lateral movement of the objects through the secured nylon tie band. This can result in issues related to the objects bundled by the tie band sliding out of position. Nylon materials may also exhibit a relatively low modulus of elasticity. Thus, nylon tie bands may provide less-than-desirable vibration damping properties. For example, where nylon tie bands are used to secure a heat exchanger within a commercial HVAC unit, the nylon tie bands may conduct vibrations produced by the HVAC unit to the heat exchanger. These vibrations may reduce the efficiency of the heat exchanger by disrupting the liquid boundary layer formed by coolant flowing through the heat exchanger.

BRIEF DESCRIPTION OF THE DRAWINGS

Embodiments of fusible tie bands and related methods are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
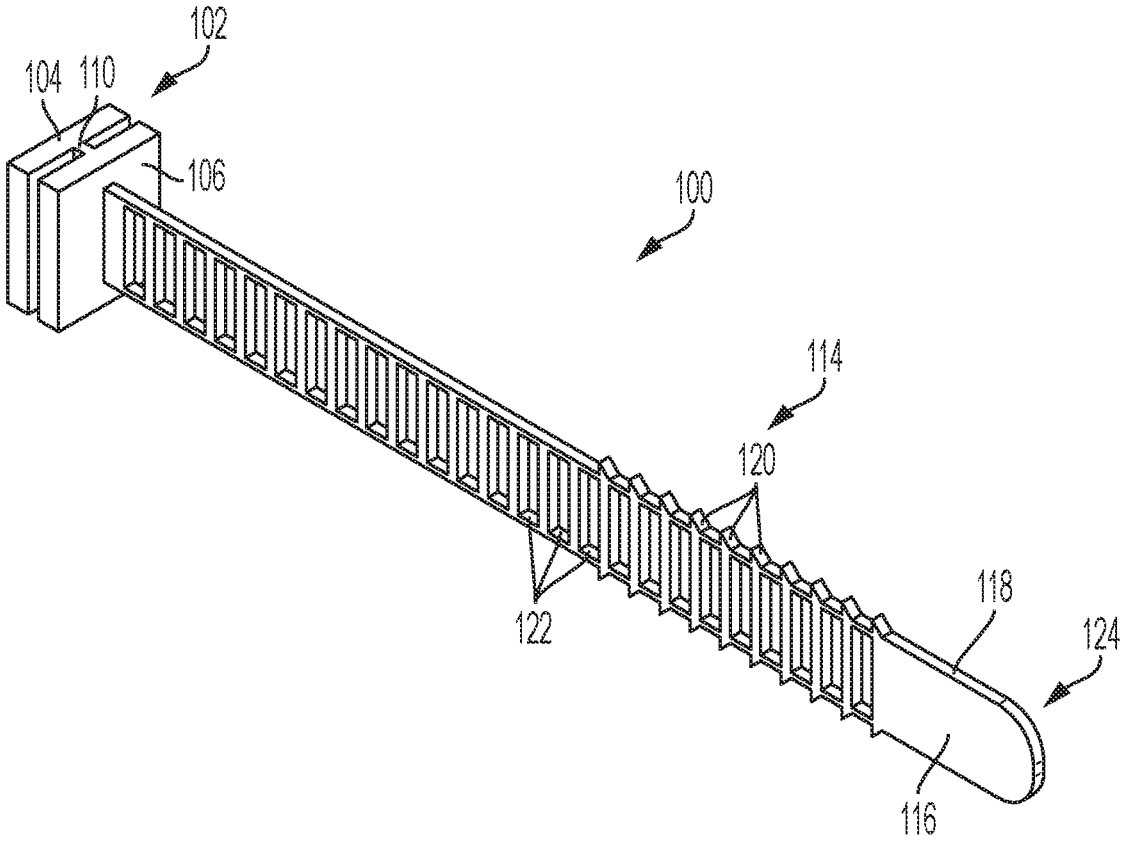
FIGS. 1-3 illustrate an example embodiment of a fusible tie band.
Figure 2:
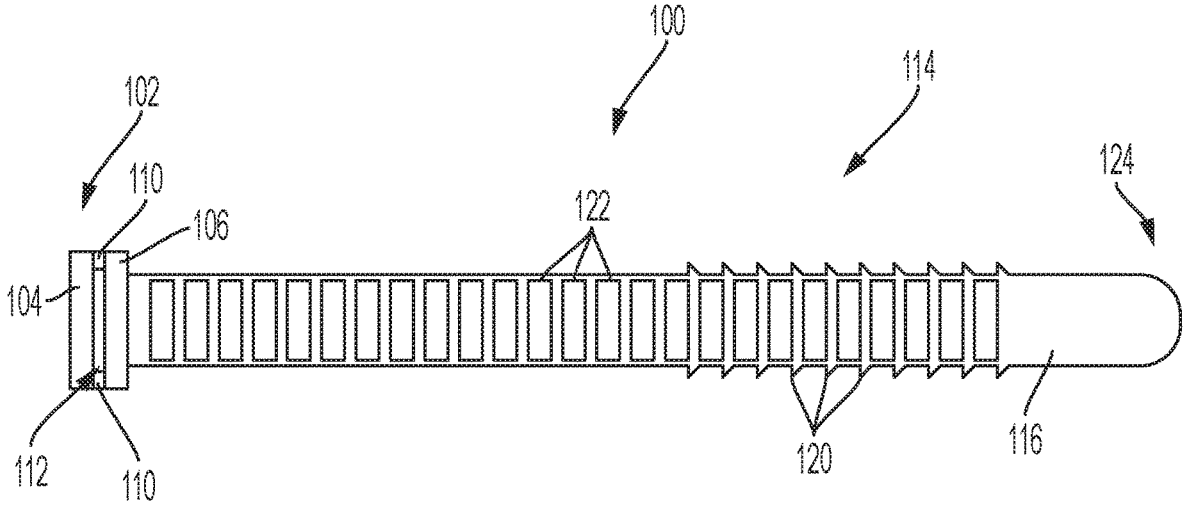
Figure 3:
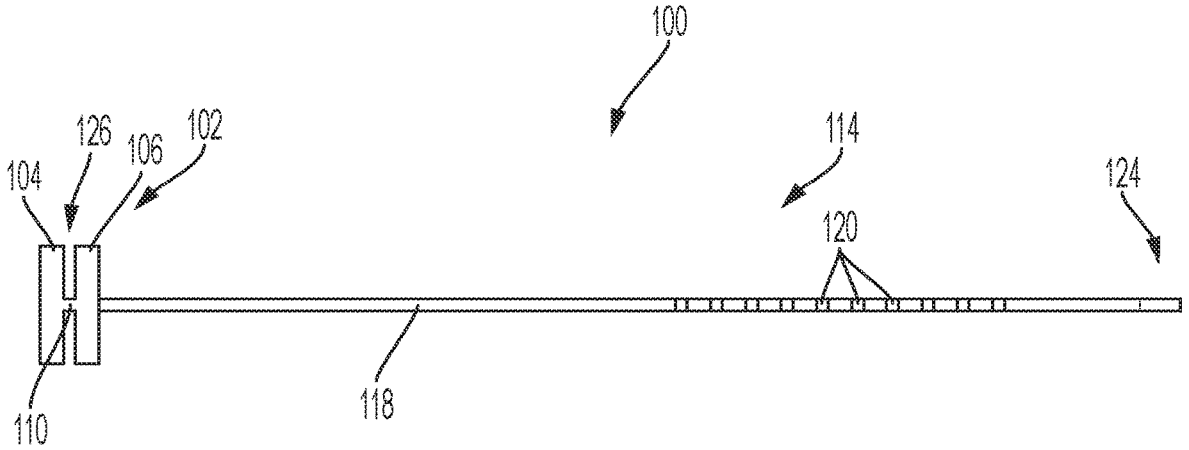
Figure 4:
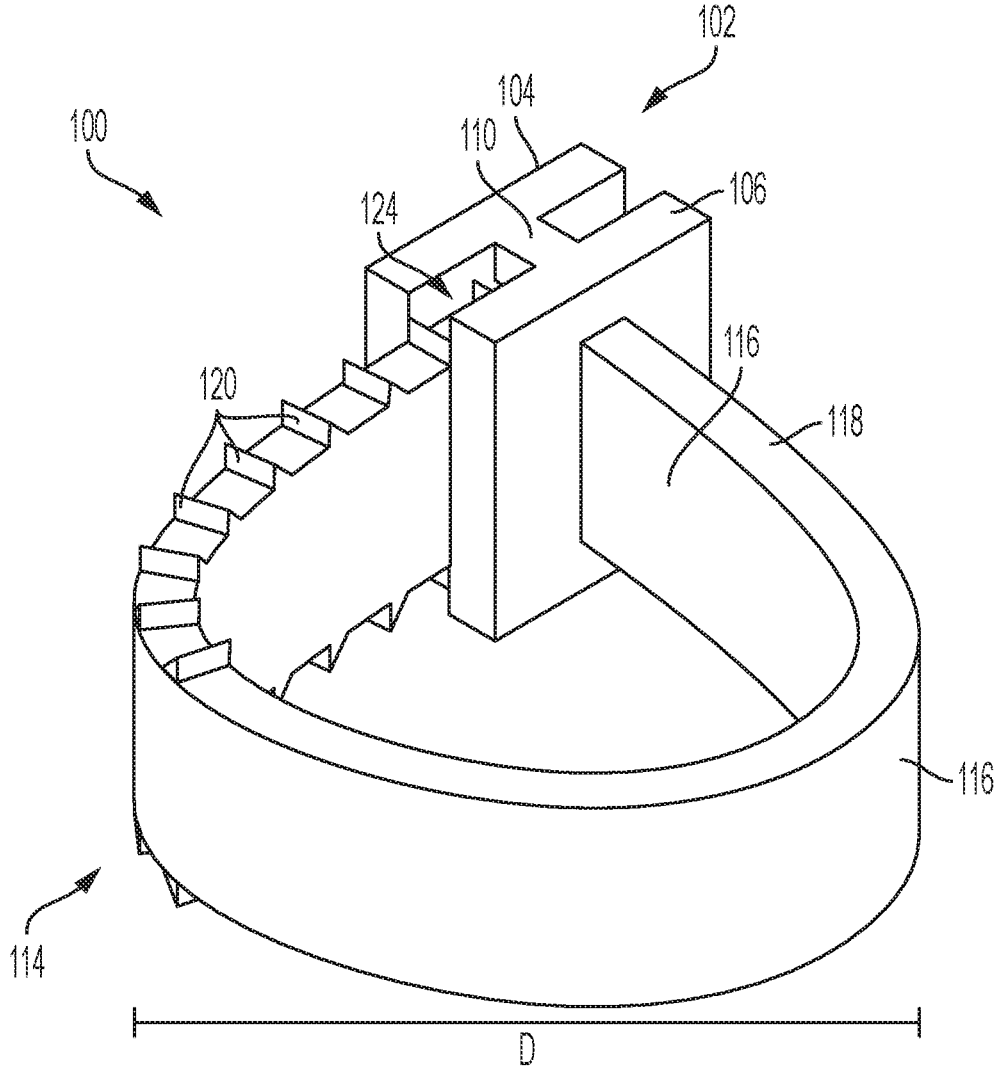
FIG. 4 illustrates a perspective view of the fusible tie band of FIGS. 1-3 in a secured position.

FIGS. 1-3 illustrate an example embodiment of a fusible tie band 100 and FIG. 4 illustrates the fusible tie band 100 in a secured position. The tie band includes a head 102 and a band 114 extending from the head 102. The end of the band 114 opposite the head 102 defines a tongue 124. The head includes a flange 104 and a flange 106 that are connected via a connector 110. As best shown in FIG. 2, the connector 110, the flange 104, and the flange 106 define a hole 112 in the head 102. And as shown in FIG. 4, the band 114 is bendable such that a portion of the band 114 may be inserted through the hole 112 defined in the head 102. Inserting a portion of the band 114 through the hole 112 may fixate the fusible tie band 100 in the secured position. Further, the band 114 of the fusible tie band 100 may be wrapped around one or more than one object while inserting the portion of the band 114 through the hole 112 to hold together or otherwise secure the one or more than one objects when the fusible tie band 100 is in the secured position.

The fusible tie band 100 may be constructed of a thermoplastic material, such as thermoplastic polyurethane. Suitable thermoplastic polyurethane materials may include polyester-type thermoplastic polyurethane, polyether-type thermoplastic polyurethane, polycaprolactone-type thermoplastic polyurethane, polycarbonate diol-type thermoplastic polyurethane, copolymers thereof, and/or combinations thereof.

Various portions of the head 102 and the band 114 may be fused together once the fusible tie band 100 is in the secured position. In aspects where the fusible tie band 100 is constructed using thermoplastic material, such as thermoplastic polyurethane, portions of the head 102 and the band 114 may fused together by the application of heat thereto, as discussed in more detail below. Fusing portions of the head 102 and the band 114 together when the fusible tie band 100 is in the secured position can enable the fusible tie band 100 to exhibit a higher retention force (e.g., a total retention force of greater than 300 N) compared to a tie band that is not fused. Further, as a result of this higher retention force, the fusible tie band 100 may be less prone to failure compared to tie bands that are not fused. For example, once fused, it may be more difficult to break, retract, or otherwise remove the band 114 from the head 102 compared to tie bands that are not fused. Further, attempting to fuse a conventional tie band by applying heat thereto may cause the conventional tie band to melt and/or may cause the conventional tie band to become brittle and more prone to failure. Therefore, the fusible tie band 100 may more reliably secure objects together or otherwise fasten objects compared to conventional tie bands.

The fusible tie band 100 can provide numerous technical benefits. For example, compared to existing tie bands (e.g., nylon tie bands), a fusible tie band 100 constructed of thermoplastic polyurethane may exhibit a higher coefficient of friction when placed against other materials such as electrical wire insulation or the metal used to construct HVAC units. Thus, when used to bundle objects together, such as electrical wires, the fusible tie band 100 may provide improved resistance to lateral movement of the objects.

In addition to or in lieu of the above, a fusible tie band 100 constructed of thermoplastic polyurethane may exhibit a higher modulus of elasticity compared to existing tie bands (e.g., nylon tie bands). As a result of this higher modulus of elasticity, the fusible tie band 100 may dampen vibrations better than existing tie bands. For example, it is believed that using the fusible tie band 100 to secure a heat exchanger within a commercial HVAC unit will dampen vibrations transmitted from motors and/or fans within the HVAC unit to the heat exchanger better than existing tie bands, such as a nylon tie bands.

Still referring to FIGS. 1-4, the band 114 of the fusible tie band 100 includes two opposing elongate faces 116 and two opposing side faces 118 (only one of the elongate faces 116 and one of the side faces 118 are viewable in FIG. 1). The elongate faces 116 are wider than the side faces 118. Further, the elongate faces 116 and the side faces 118 are dimensioned such that a portion of the band 114 can be positioned between the flange 104 and the flange 106 and inserted through the hole 112 defined in the head 102 to fixate the fusible tie band 100 in the secured position.

The band 114 of the fusible tie band 100 may include one pair or more than one pair of protrusions 120 (e.g., teeth, bumps, tabs, etc.) that extend from one or both of the side faces 118 to retain the fusible tie band 100 the secured position when a portion of the band 114 is inserted through the hole 112 defined in the head 102. In the embodiment shown in FIGS. 1-4, the fusible tie band 100 includes protrusions 120 that are shaped (e.g., angled) such that the protrusions 120 can pass through the hole 112 defined in the head 102 as the band 114 is inserted through the hole 112 but resist removal or retraction of the band 114 once it has been inserted through the hole 112.

Including multiple protrusions 120 on the band 114 allows the fusible tie band 100 to be adjustably set in secured positions having varying bundle diameters. For example, FIG. 4 shows the fusible tie band 100 in a secured position with a bundle diameter "D". As a larger portion of the band 114 is slid through the head 102 and more pairs of protrusions 120 pass through the hole 112 defined in the head 102, the bundle diameter "D" decreases. Thus, the fusible tie band 100 can be adjusted to wrap around and secure one or more than one object of varying sizes. Further, because the protrusions 120 may be shaped (e.g., angled) to resist removal or retraction of the band 114 once inserted through the hole 112, the fusible tie band 100 can be increasingly tightened around the one or more than one objects in a ratcheting manner. The size, shape, spacing, positioning, and/or number of pairs of protrusions 120 may be varied, for example, to enable the fusible tie band 100 to achieve various combinations of desired bundle diameters "D".

Still referring to FIGS. 1-4, and as noted above, the head includes a flange 104 and a flange 106 that are connected via a connector 110. Although FIGS. 1-4 depicts the flange 104 and the flange 106 having a rectangular shape, the size and shape of the flange 104 and/or the flange 106 can be adjusted and/or configured to serve various functions. For example, the size and shape of the flange 104 and the flange 106 may be structured to support and resist deformation of the hole 112 defined by the flange 104, the flange, 106, and the connector 110. By providing structural support to resist deformation of the hole 112, the flange 104 and/or the flange 106 may prevent the protrusions 120 from deforming the hole 112 enough to retract the band 114 from the head 102 once the fusible tie band 100 has been set in a secured position, such as the secured position shown in FIG. 4.

In addition to or in lieu of the above, the size and shape of the flange 104, the flange 106, and/or the tongue 124 may be structured to facilitate (e.g., guide) the insertion of the band 114 into the hole 112 defined in the head 102. For example, as best shown by FIG. 3, the flange 104 and the flange 106 define a space 126 therebetween. The tongue 124 of the band 114 can be positioned within the space 126 defined by the flange 104 and the flange 106 to at least partially align the tongue 124 with the hole 112 prior to the tongue 124 being inserted into the hole 112. The tongue 124 may be shaped (e.g., tapered, rounded, etc.) to facilitate the initial insertion of the band 114 into the hole 112. Further, a user of the fusible tie band 100 may grasp (e.g., pinch) the flange 104 and the flange 106 with one hand while guiding the tongue 124 into the space 126 and into the hole 112 defined in the head 102 with the other hand. In some aspects, pinching the flange 104 and the flange 106 towards each other may cause the hole 112 to deform (e.g. widen along its elongated dimension). This deformation can create additional room in the hole 112 proximate to the side faces 118 of the band so that the protrusions 120 can be more easily passed through the hole 112. Upon achieving a desired secured position of the fusible tie band, the pinch of the flange 104 and the flange 106 may be released to return the hole 112 to a non-deformed state that resists retraction of the protrusions 120. Thus, the flange 104 and the flange 106 may facilitate the insertion of at least a portion of the band 114 through the hole 112.

In addition to or in lieu of the above, the size and shape of the flange 104 and the flange 106 may be structured to shield the protrusions 120 proximate to the hole 112 when the fusible tie band 100 is in a secured position, as shown in FIG. 4. By acting as shields, the flange 104 and the flange 106 may prevent objects from inadvertently contacting the protrusions 120 proximate to the hole 112 and/or the structures defining the hole 112. Preventing objects from inadvertently contacting the protrusions 120 proximate to the hole 112 and/or the structures defining the hole 112 may therefore prevent the fusible tie band 100 from inadvertently releasing from its secured position. For example, without shielding from the flanges 104, 106, an object contacting the fusible tie band 100 may shave or otherwise deteriorate the protrusions 120 proximate to the hole 112 allowing the band 114 to retract out of the secured position.

As noted above, when the fusible tie band 100 is in a secured position, at least a portion of the head 102 and at least a portion of the band 114 may be fused together. The fusion of the head 102 and the band 114 may result in the fusible tie band 100 having a greater retention force when in the secured position compared to a tie band that is not fused. Fusion of the head 102 and the band 114 may be achieved by applying heat to at least a portion of the head 102 and/or at least a portion of the band 114, for example, using a heating rod or a soldering iron.

Various portions of the head 102 and the band 114 may be fused together. For example, referring primarily to FIG. 4, heat may be applied to one or more than one protrusion 120 that is proximate to the head 102 (e.g., a pair of protrusions 120 proximate to the head 102). The application of heat to one or more than one protrusion 120 that is proximate to the head 102 may cause the material forming the one or more than one protrusion 120 and at least a portion of the head 102 (e.g., the flange 104, the flange 106, and/or the connector 110) to transition to a liquid phase and fuse together upon cooling. As another example, heat may be applied to a portion of the band 114 that is proximate to the head 102 causing the material forming the band 114 and at least a portion of the head 102 (e.g., the flange 104, the flange 106, and/or the connector 110) to transition to a liquid phase and fuse together upon cooling. As yet another example, heat may be applied to at least a portion of the head 102 (e.g., the flange 104, the flange 106, and/or the connector 110) causing the material forming the at least a portion of the head 102 and at least a portion of the band 114 (e.g. one or more than one protrusion 120) to transition to a liquid phase and fuse together upon cooling. Fusion between the head 102 and the band 114 may also be achieved by any combination of the examples above and/or by applying heat to the entire head 102 and structures of the band 114 that are proximate to the head 102.

The fusible tie band 100 may include one or more than one hole 122 that extends through the band 114 across the opposing elongate faces 116 of the band 114. In the embodiment shown in FIGS. 1-2, the fusible tie band 100 includes a plurality of holes 122 that extend through the band 114 across the elongate faces 116 of the band 114. The holes 122 can be configured to achieve a desired elasticity of the band 114. For example, as a result of positioning the holes 122 spaced along the elongated face 116 of the band 114, the band 114 of the fusible tie band 100 shown in FIGS. 1-2 may be more elastic compared to a tie band that does not include holes 122. Further, including larger and/or more holes 122 may cause the band 114 to be more elastic than a band 114 that has smaller and/or fewer holes 122.

The holes 122 in the band 114 can be configured in any shape, such as the rectangular shape shown in FIGS. 1-2, or other shapes such as an oval shape, a circular shape, or any polygonal shape. However, rectangular-shaped holes 122 (e.g., square-shaped holes 122) may provide more resistance rotation of the fusible tie band 100 about an object or objects the fusible tie band 100 is securing compared to holes 122 that are not rectangular in shape. For example, the edges of rectangular-shaped holes 122 may grip the object or objects the fusible tie band 100 is securing to resist rotation of the fusible tie band 100. This resistance to rotation may prevent the object or objects from becoming dislodged or sliding out of position. The size, shape, spacing, positioning, and/or number of holes 122 may be varied to enable the band 114 to achieve a desired elasticity and/or a desired resistance to rotation.

In some aspects, the fusible tie band 100 can include both holes 122 that extend through the band 114 and protrusions 120 that extend from the band 114. Configuring the protrusions 120 to extend from the side faces 118 of the band 114 may beneficially enable the holes 112 to be included in the band 114 while maintaining various structural properties of the band 114. For example, if the protrusions 120 were configured to extend from the elongated faces 116 of the band 114, then the holes 122 extending through the elongated faces 116 of the band 114 may need to be positioned longitudinally relative to the protrusions 120 and in an alternating arrangement with the protrusions 120 (e.g., with the protrusions 120 positioned on "ladder rungs" defined between the holes 122). However, with this configuration, inserting the band 114 into the hole 112 may cause the band 114 (e.g., the protrusions 120, the ladder rung on which the protrusions 120 are positioned) to stretch. The stretching of the band 114 may impede the insertion of the band 114 into the hole 112 (e.g., making it difficult to insert the band 114 into the hole 112). Furthermore, the stretching of the band 114 may cause permanent deformation of the band 114 (e.g., permanent deformation of the protrusions 120, permanent deformation of the ladder rungs on which the protrusions 120 are positioned). Conversely, by configuring the protrusions 120 to extend from the thinner, side faces 118 of the band 114, the fusible tie band 100 may exhibit relatively less stretching and deformation (e.g., elongation) when being inserted into the hole 112. The stretching and deformation of the band 114 may be further limited by configuring the protrusions 120 extending from the side faces 118 of the band 114 to be longitudinally spaced from the holes 122 and in an alternating arrangement with the holes 122, as shown in FIGS. 1-2.

Figure 5:
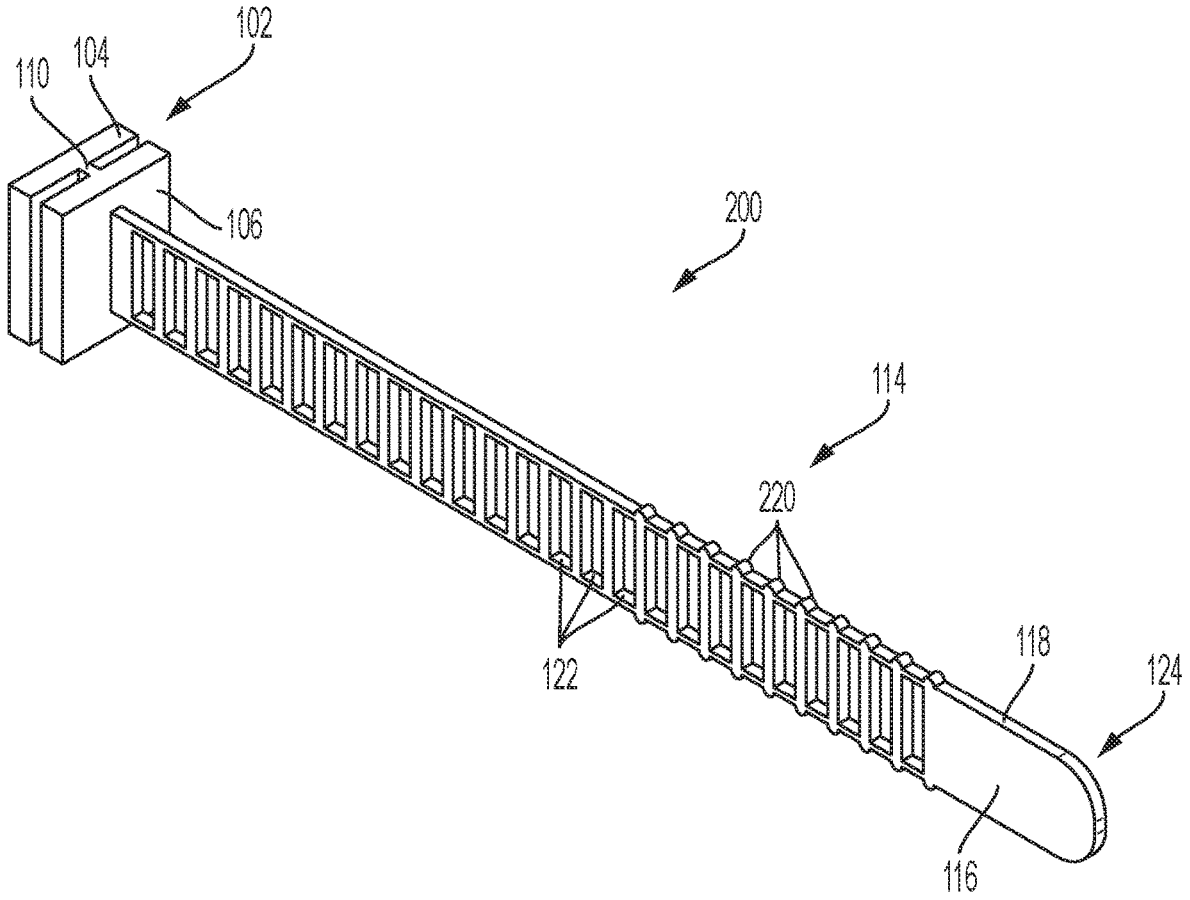
FIG. 5-7 illustrate an example embodiment of a fusible and releasable tie band.
Figure 6:
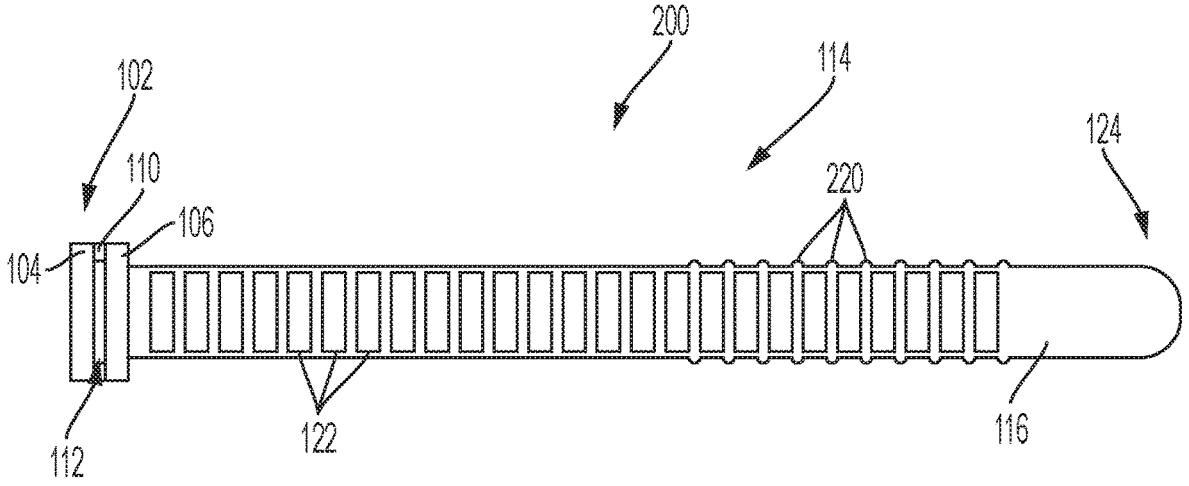
Figure 7:
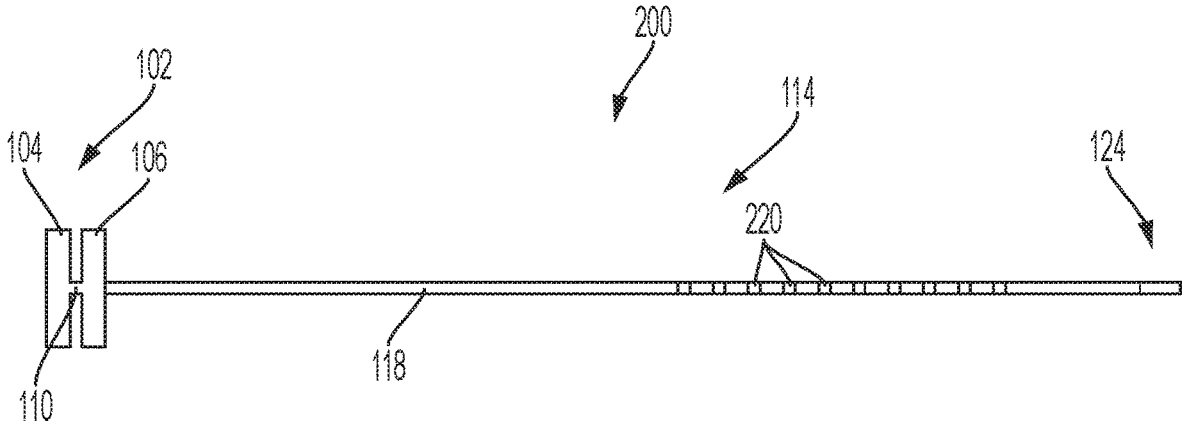

FIGS. 5-7 illustrate an example embodiment of a fusible tie band 200 that is releasable. The fusible tie band 200 is similar to the fusible tie band 100 depicted in FIGS. 1-3 except that the tie band 200 includes protrusions 220 instead of the protrusions 120. The protrusions 220 may similarly retain the fusible tie band 100 in a secured position when a portion of the band 114 is inserted through the hole 112 defined in the head 102. In the embodiment shown in FIGS. 5-7, the protrusions 220 are rounded such that the protrusions 220 can pass through the hole 112 defined in the head 102 as the band 114 is inserted through the hole 112 and can also be reversibly retracted from the hole 112. Although the protrusions 220 are configured to allow movement of the band 114 through the hole 112 in both the inserting and removing direction, the protrusions 220 provide resistance to movement of the band 114 in these directions. Thus, rather than acting as a ratcheting mechanism for securing the fusible tie band 200, the protrusions 220 allow the bundle diameter to be bilaterally adjusted. For example, if the fusible tie band 200 is positioned in a secured position with a bundle diameter that is smaller than desired (e.g., positioned too tightly around an object), then the fusible tie band 200 may be reversibly adjusted to have a larger bundle diameter. Further, once the desired bundle diameter is achieved, at least a portion of the head 102 and at least a portion of the band 114 can be fused together as described above. Accordingly, unlike traditional tie bands, the fusible tie band 200 can be reversibly adjusted. Moreover, the ability of the fusible tie band 200 to be reversible adjusted may not result in a diminished retention force because the head 102 and the band 114 may be subsequently fused together.

Various additive and/or subtractive manufacturing techniques may be used to form the fusible tie band 100, 200. For example, in some aspects, the fusible tie band 100, 200 may be injection molded. In other aspects, the fusible tie band 100, 200 may be 3D printed. In yet other aspects, the head 102 and/or the band 114 of fusible tie band 100, 200 may be injection molded or 3D printed and then various features of the head 102 and/or the band 114, such as the hole 112, the space 126, the holes 122, and/or the protrusions 120, 220 may be formed subtractively. For example, various features of the head 102 and/or the band 114 may be drilled, cut, and/or stamped.

Figure 8:
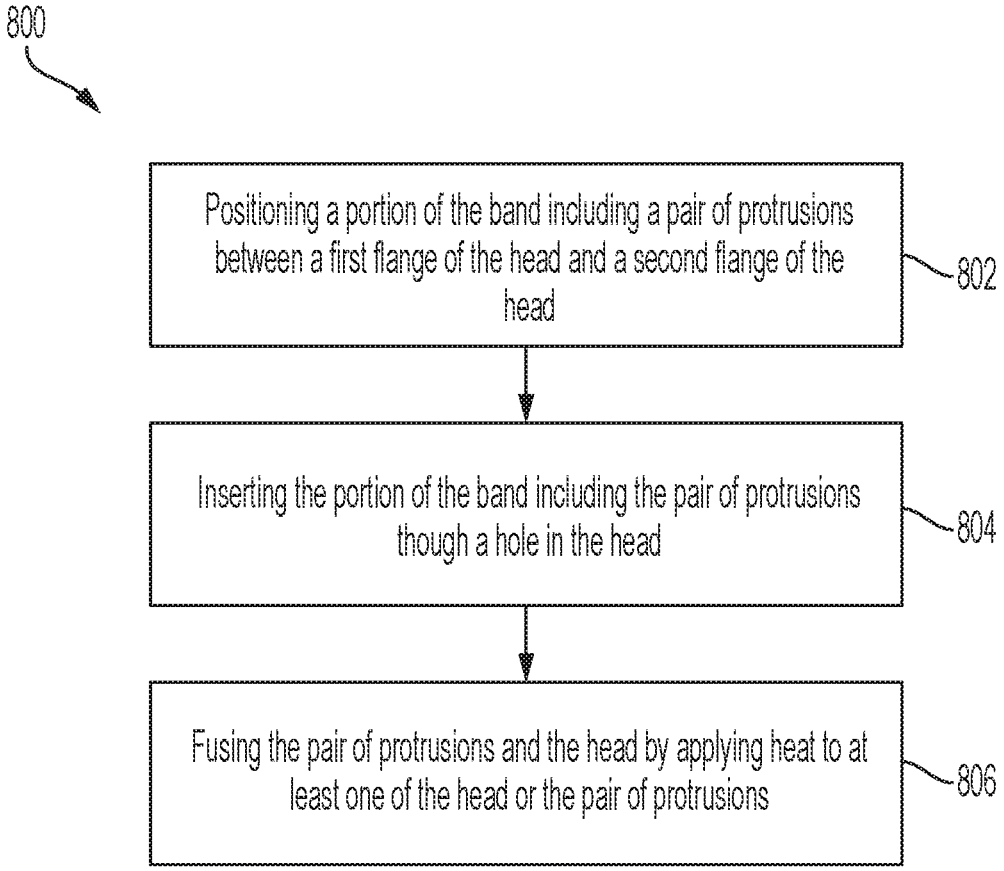
FIG. 8 illustrates a method for securing a fusible tie band.

FIG. 8 illustrates a flowchart of a method 800 for securing a fusible tie band. The fusible tie band may be any of the fusible tie bands disclosed herein, such as the fusible tie band 100 or the fusible tie band 200. The fusible tie band includes a head and a band extending from the head. The band includes two elongated faces, two side faces, and a pair of protrusions extending from the side faces. The method 800 includes positioning 802 a portion of the band including the pair of protrusions between a first flange of the head and the second flange of the head. The method 800 also includes inserting 804 the portion of the band including the pair of protrusions though a hole in the head. Further, the method 800 includes fusing 806 the pair of protrusions and the head by applying heat to at least one of the head or the pair of protrusions.

According to one aspect of the method 800, inserting 804 the portion of the band comprising the pair of protrusions though the hole in the head further includes pinching the first flange and the second flange towards each other to adjust the shape of the hole (e.g., deforming the hole). Adjusting the shape of the hole may facilitate the insertion 804 of the portion of the band comprising the pair of protrusions though the hole.

According to one aspect of the method 800, each protrusion of the pair of protrusions is shaped (e.g., angled) to resist removal of the portion of the band including the pair of protrusions from the hole after the portion of the band including the pair of protrusions is inserted 804 through the hole.

According to one aspect of the method 800, each protrusion of the pair of protrusions is rounded and the method 800 further includes removing the portion of the band including the pair of protrusions from the hole after inserting 804 the portion of the band comprising the pair of protrusions through the hole.

Further examples of the present disclosure may include:

Example 1 is a tie band. The tie band includes a head and a band extending from the head. The head includes a first flange, a second flange, and a connector connecting the first flange and the second flange. The connector defines a hole in the head. The band includes two elongate faces, two side faces, and a protrusions extending from the side faces. A portion of the band including the protrusions is configured to be inserted between the first flange and the second flange and through the hole.

In Example 2, the subject matter of Example 1 can further include wherein the protrusions are shaped such that when the portion of the band is inserted through the hole, a pair of the protrusions resists removal of the portion of the band from the hole so as to fixate the tie band in a secured position.

In Example 3, the subject matter of Example 1 can further wherein the protrusions are rounded such that the portion of the band comprising the protrusions is removable from the hole when inserted therethrough.

In Example 4, the subject matter of Examples 1-3 can further include wherein the protrusions comprise a material fusible to the head.

In Example 5, the subject matter of Examples 1-4 can further include wherein the head and the band comprise a thermoplastic polyurethane material.

In Example 6, the subject matter of Examples 1-5 can further include wherein the protrusions extending from the side faces of the band comprise protrusions extending from and spaced along each of the side faces of the band.

In Example 7, the subject matter of Examples 1-6 can further include wherein the band further comprises holes extending through the elongate faces of the band.

In Example 8, the subject matter of Example 7 can further include wherein the protrusions are longitudinally offset from at least some of the holes.

Example 9 is a tie band. The tie band includes a head and a band extending from the head. The head includes a first flange, a second flange, and a connector connecting the first flange and the second flange. The connector defines a hole in the head. A portion of the band is configured to be inserted through the hole. The band includes two elongate faces, two side faces, and protrusions extending from the side faces. The band is fusible to the head by applying heat to the head, at least one of the protrusions, or a combination thereof when the portion of the band is inserted through the hole.

In Example 10, the subject matter of Example 9 can further include wherein the protrusions are shaped such that when the portion of the band is inserted through the hole, a pair of the protrusions resists removal of the portion of the band from the hole so as to fixate the tie band in a secured position.

In Example 11, the subject matter of Example 9 can further include wherein the protrusions are rounded such that the portion of the band comprising the protrusions is removable from the hole before fusing the band to the head.

In Example 12, the subject matter of Examples 9-11 can further include wherein the head and the band comprise a thermoplastic polyurethane material.

In Example 13, the subject matter of Examples 9-12 can further include wherein the protrusions extending from the side face of the band comprises protrusions extending from and spaced along each of the side face of the band.

In Example 14, the subject matter of Examples 9-13 can further include wherein band further comprises holes extending through the elongate faces of the band.

In Example 15, the subject matter of Examples 9-14 can further include wherein the protrusions are longitudinally offset from at least some of the holes.

Example 16 is a method of securing a fusible tie band. The fusible tie band includes head and a band extending from the head. The method can include positioning a portion of the band comprising a pair of protrusions between a first flange of the head and the second flange of the head. The band includes two elongate faces and two side faces. The pair of protrusions extend from the side faces. The method can further include inserting the portion of the band comprising the pair of protrusions though a hole in the head. The method can further include fusing the pair of protrusions and the head by applying heat to at least one of the head or the pair of protrusions.

In Example 17, the subject matter of Example 16 can further include wherein inserting the portion of the band comprising the pair of protrusions though the hole in the head further comprises pinching the first flange and the second flange towards each other to adjust the shape of the hole to facilitate the insertion of the portion of the band comprising the pair of protrusions though the hole.

In Example 18, the subject matter of Examples 16-17 can further include wherein each of the protrusions of the pair of protrusions is shaped to resist removal of the portion of the band comprising the pair of protrusions from the hole after the portion of the band comprising the pair of protrusions is inserted through the hole.

In Example 19, the subject matter of Example 16-17 can further include wherein each of the protrusions of the pair of protrusions is rounded, the method further comprising removing the portion of the band comprising the pair of protrusions from the hole after inserting the portion of the band comprising the pair of protrusions through the hole.

In Example 20, the subject matter of Example 16-19 can further include wherein the head and the band comprise thermoplastic polyurethane.

One or more specific embodiments of the fusible tie band and related methods have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "embodiments," "some embodiments," "certain embodiments," "aspects" or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A tie band comprising:
a head comprising:
a first flange;
a second flange; and
a connector connecting the first flange and the second flange, wherein the connector, the first flange, and the second flange define a hole in the head; and
a band comprising fusible material and extending perpendicularly from the head in the same direction as the connector, the band comprising:
two elongate faces;
two side faces; and
protrusions extending from the side faces, wherein a portion of the band comprising the protrusions is configured to be inserted between the first flange and the second flange and through the hole, and wherein the protrusions are fusible to the head in a secured position by applying heat to at least one of the head or at least one of the protrusions.

2. The tie band of claim 1, wherein the protrusions are shaped such that when the portion of the band is inserted through the hole, a pair of the protrusions resists removal of the portion of the band from the hole to fixate the tie band in a secured position.

3. The tie band of claim 1, wherein the protrusions are rounded such that the portion of the band comprising the protrusions is removable from the hole when inserted therethrough.

4. The tie band of claim 1, wherein the protrusions comprise a material fusible to the head.

5. The tie band of claim 1, wherein the head and the band comprise a thermoplastic polyurethane material.

6. The tie band of claim 1, wherein the protrusions extending from the side faces of the band comprise protrusions extending from and spaced along each of the side faces of the band.

7. The tie band of claim 6, wherein the band further comprises holes extending through the elongate faces of the band.

8. The tie band of claim 7, wherein the protrusions are longitudinally offset from at least some of the holes.

9. A tie band comprising:
a head comprising:
a first flange;
a second flange; and
a connector connecting the first flange and the second flange, wherein the connector, the first flange, and the second flange define a hole in the head; and
a band comprising fusible material and extending perpendicularly from the head in the same direction as the connector, wherein a portion of the band is configured to be inserted through the hole, and wherein the band comprises:
two elongate faces;
two side faces; and
protrusions extending from the side faces,
wherein the protrusions are fusible to the head in a secured position by applying heat to the head, at least one of the protrusions, or a combination thereof when the portion of the band is inserted through the hole.

10. The tie band of claim 9, wherein the protrusions are shaped such that when the portion of the band is inserted through the hole, a pair of the protrusions resists removal of the portion of the band from the hole to fixate the tie band in a secured position.

11. The tie band of claim 9, wherein the protrusions are rounded such that the portion of the band comprising the protrusions is removable from the hole before fusing the band to the head.

12. The tie band of claim 9, wherein the head and the band comprise a thermoplastic polyurethane material.

13. The tie band of claim 9, wherein the protrusions extending from the side face of the band comprise protrusions extending from and spaced along each of the side faces of the band.

14. The tie band of claim 9, wherein the band further comprises holes extending through the elongate faces of the band.

15. The tie band of claim 14, wherein the protrusions are longitudinally offset from at least some of the holes.

16. A method of securing a fusible tie band comprising a head and a band extending from the head, the method comprising:
positioning a portion of the band comprising a pair of protrusions between a first flange of the head and a second flange of the head, wherein the band comprises two elongate faces and two side faces, and wherein the pair of protrusions extend from the side faces;
inserting the portion of the band comprising the pair of protrusions through a hole in the head; and
fusing the pair of protrusions and the head by applying heat to at least one of the head or the pair of protrusions.

17. The method of claim 16, wherein inserting the portion of the band comprising the pair of protrusions through the hole in the head further comprises pinching the first flange and the second flange towards each other to adjust a shape of the hole to facilitate the insertion of the portion of the band comprising the pair of protrusions through the hole.

18. The method of claim 16, wherein each protrusion of the pair of protrusions is shaped to resist removal of the portion of the band comprising the pair of protrusions from the hole after the portion of the band comprising the pair of protrusions is inserted through the hole.

19. The method of claim 16, wherein each protrusion of the pair of protrusions is rounded, the method further comprising removing the portion of the band comprising the pair of protrusions from the hole after inserting the portion of the band comprising the pair of protrusions through the hole.

20. The method of claim 16, wherein the head and the band comprise thermoplastic polyurethane that are fusible together.

* * * * *